United States Patent [19]

Collins

[11] Patent Number: 4,757,938

[45] Date of Patent: Jul. 19, 1988

[54] BLANK FORMING A PARTITION STRENGTHENING A BOX

[75] Inventor: Arthur B. Collins, Oakville, Canada

[73] Assignee: Domtar Inc., Montreal, Canada

[21] Appl. No.: 8,760

[22] Filed: Jan. 30, 1987

[51] Int. Cl.[4] ..... B65D 5/46; B65D 5/48

[52] U.S. Cl. ..... 229/120.05; 229/52 B; 229/120.38; 229/199

[58] Field of Search ..... 229/15, 27, 52 B, 199, 229/120.05, 120.38

[56] References Cited

U.S. PATENT DOCUMENTS

| | | | |
|---|---|---|---|
| 2,191,180 | 2/1940 | Reaume | 229/52 B |
| 2,284,385 | 5/1942 | Freshwaters | 229/15 |
| 2,961,143 | 11/1960 | Forrer | 229/28 |
| 3,048,318 | 8/1962 | Sabin | 229/15 |
| 3,291,371 | 12/1966 | Atkinson | 229/120.05 |
| 4,157,755 | 6/1979 | Gough | 229/15 |
| 4,164,312 | 8/1979 | Harned | 229/15 |

FOREIGN PATENT DOCUMENTS

| | | | |
|---|---|---|---|
| 650568 | 10/1962 | Canada | 229/18 |
| 1025408 | 1/1978 | Canada | 229/52 B |

*Primary Examiner*—Stephen Marcus
*Assistant Examiner*—Gary E. Elkins
*Attorney, Agent, or Firm*—Antoine H. Gauvin

[57] ABSTRACT

A blank, defining an I beam partition, has a center panel extending at each end edge into a foldably connected substantially L-shaped end panel. The ell extensions of the L-shaped end panels are adjacent one of the side edges of the center panel. At least one of the L-shaped end panels has about the center of its widest portion a cut portion defining an aperture. The L-shaped end panels are bent about their edge foldably connected to the center panel, to extend substantially perpendicularly away from the center panel thus defining an I beam partition to be snugly inserted in boxes. The invention is also directed to a box having the I beam partition wherein each of the L-shaped end panels is snugly positioned adjacent one of the ends of the box to reinforce the ends. The center panel extends between the L-shaped end panels, dividing the box in two portions and cooperating with the L-shaped end panels and the ends to prevent inward and outward movements of the ends of the box. The aperture cooperates with the box's handhole to enable strengthening of the hand grasping of the box.

5 Claims, 1 Drawing Sheet

BLANK FORMING A PARTITION STRENGTHENING A BOX

FIELD OF THE INVENTION

This invention relates to partitions and blanks for forming partitions and to boxes cooperating with such partitions.

This invention relates in particular to an "I" beam partition formed from a single blank and snugly inserted within boxes to cooperate with, and strengthen boxes.

BACKGROUND OF THE INVENTION

Various types of top loading boxes for carrying especially liquid containers and including partitions within are known. However, a box and partition that are economical and easy to manufacture, yet being strong and of worthy recycling value has not yet been found.

For instance, in the bottled beverage industry, rectangular top loading boxes have apertures in the upper portion of the boxes' ends, for retail carrying convenience, and as a result of the shape or dimensions of the bottles used. The load carrying area above the apertures is small and weak and tears during handling of loaded boxes.

Some boxes, as in Canadian Pat. No. 650,568 of Oct. 16, 1962 as invented by Henry S. Wallace and William J. Hurrell, include a reinforcing tape above the apertures to reinforce the load carrying area and extending completely around the carton for ease of manufacture. The tape lies between a corrugated ply and the outer facing. A partition, for example, a 24 cell chipboard partition, is enclosed in the box to separate the bottles. However, the reinforcing tape in these boxes causes an adjacent bulge to form on the outer walls of the box. This bulge raises location problems and interference with graphic designs. Recycling of fiberboard with reinforcing tape insert is also difficult and thereby decreases its scrap sale value. Furthermore, the ends bulge outwardly when carrying the box from one end only.

On the other hand, double walled I beam partitions are known, for instance in U.S. Pat. No. 2,961,143 of Nov. 22, 1960 as invented by Homer W. Forrer. The I beam partition with two adjacent longitudinal foldably connected center walls, and having end panels at each latitudinal end edge, divides the box in two compartments. The end panels may be adjacent the box ends, the double thickness thus strengthening the load carrying area. However, this design is costly to manufacture and requires numerous steps in folding a blank into an I beam and inserting the latter within the box.

It is an object of the present invention to provide a simple, easy to manufacture, inexpensive, yet strong two cell box formed from separate partition and box blanks. In a particular embodiment, it is also an object of this invention to provide a partitioned box having an improved scrap sale value.

BRIEF DESCRIPTION OF THE INVENTION

Broadly stated, the invention is directed to a fiberboard blank having a center panel with opposite side and end edges, said center panel extending at each of said end edges to define foldably connected substantially L-shaped end panels with the ell extensions adjacent one of said side edges of said center panel, at least one of said L-shaped end panels hving about the center of its widest portion a cut portion defining an aperture, whereby each of said L-shaped end panels foldably connected to each end edge of said center panel, on being bent about said end edges extends substantially perpendicularly away from said center panel thereby defining an I beam partition to be snugly inserted in boxes to provide a strengthening partition and to thereby strengthen the boxes' ends, said I beam partition preventing inward and outward movements of the ends of boxes.

The invention is also directed to a top loading fiberboard box having opposite sides and ends in foldably connected arrangement, each of said sides and ends extending, respectively, into a foldably connected bottom and top flap, means of fastening said bottom flaps to define a bottom, at least one of said ends having near its upper portion and about its vertical center a handhole, and further including a blank as defined in claim 1 wherein said L-shaped end panels foldably connected to each end edge of said center panel are bent about said end edges thereby extending substantially perpendicularly away from said center panel defining an I beam partition having L-shaped end panels, each of said L-shaped end panels snugly positioned adjacent one of said ends to reinforce said ends, said center panel extending between said L-shaped end panels dividing said box in two portions and cooperating with said L-shaped end panels and said ends thereby preventing inward and outward movements of the ends of said box, said aperture cooperating with said handhole to enable hand grasping of said box and I beam partition.

BRIEF DESCRIPTION OF THE DRAWINGS

Referring now to the drawings which illustrate the invention.

Referring now to FIG. 1, the blank comprises center panel 50, preferably being longitudinal with opposed end edges 52, 54 and side edges 56, 58. Center panel 50 extends via end edges (fold lines) 52, 54 into foldably connected substantially L-shaped end panels 60, 62, the inner edge of the upward leg of the "L's" coinciding with fold lines 52, 54. The ell extensions of L-shaped end panels 60, 62 must be adjacent a same side edge of center panel 50, for example side edge 56 as shown, and thereby facing each other.

Figure 1:
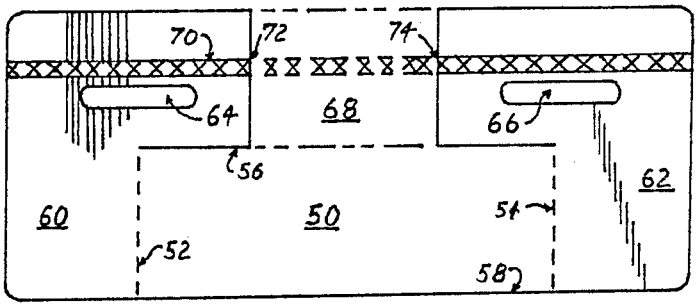
FIG. 1 is a plan view of a blank in accordance with a preferred embodiment of the invention.

For sake of clarity, dimensions parallel to end edge 52 shall be considered as heights and parallel to side edge 58 as widths.

At least one of the end panels 60, 62 preferably both, have in their widest area a cut portion defining apertures 64, 66 respectively: The widest areas comprising, as shown, that area of each L-shaped end panel 60, 62 considered above imaginarily longitudinally extended side edge 56.

Figure 2:
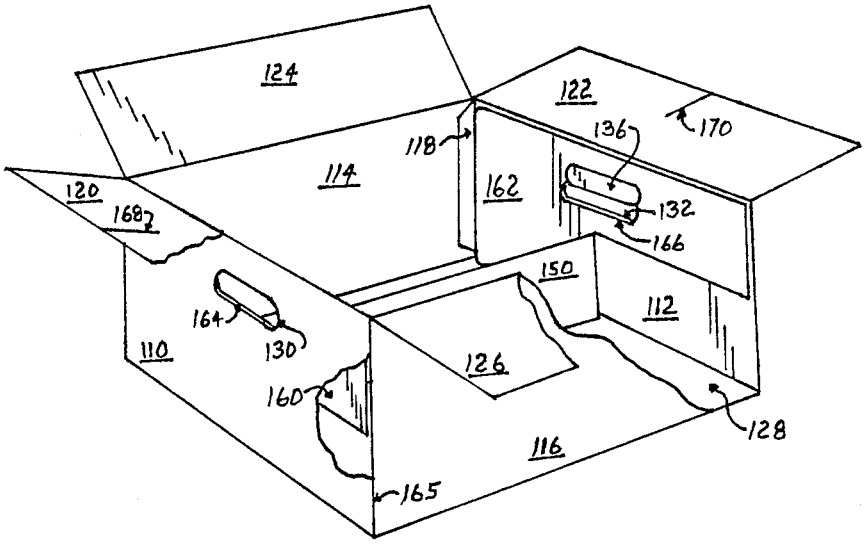
FIG. 2 is an isometric view of an erected I beam blank inserted within a box, in accordance with one embodiment of the invention.

L-shaped end panels 60, 62 are to be bent about end edges (fold lines) 52, 54 respectively, in order to be substantially perpendicular to center panel 50. This defines an I beam to be used as a partition in boxes, as shown in FIG. 2. The end panels 60, 62 may be bent such that their ell extensions point in the same direction or preferably in opposite directions.

Apertures 64, 66 are preferably substantially vertically and horizontally centered in the widest areas of end panels 60, 62. When the blank is formed into an I beam partition and inserted in a box, as in FIG. 2, the apertures 64, 66 preferably align and cooperate with handholes in the ends of the box to enable hand grasping of the box and I beam partition within. The I beam could also be inverted with the apertures 64, 66 and the box handholes being in a lower position.

Preferably, center panel 50 extends between the ell extensions of end panels 60, 62 into extension panel 68, shown in broken lines as optional. A reinforcing band 70 optionally extends across the blank, adjacent apertures 64, 66, to reinforce the load carrying areas above and to diffuse the load away from these apertures when additional carrying strength is required, to be later described.

To facilitate manufacturing of the blank including reinforcing band 70, the blank, usually of corrugated fiberboard of multiple ply, has band 70 preferably within two of its multiple plies and extending completely across the blank. Band 70 is then cut at 72, 74 between the end panels 60, 62 and extension panel 68. Otherwise, if extension panel 68 is omitted, reinforcing band 70 shall be in two sections, one section above each aperture 64, 66.

In the case of an inverted I beam partition, as aforementioned, reinforcing band 70, in order to reinforce and diffuse the load away from the load carrying area, would be on the opposite side of apertures 64, 66 than is shown in FIG. 1. Reinforcing band 70 is such as tape, ribbon, strings or the like of width and strength as desired. Reinforcing tapes or ribbons are preferably of the type having elongated filaments longitudinally oriented to increase the tensile properties of the tape or ribbon.

The cooperation of the I beam partition, formed from the blank, and a box shall be better described below.

Referring now to FIG. 2, the top loading box preferably comprises opposite ends 110, 112 and sides 114, 116 which are foldably connected in series, the first and last panel in the series being fastened, for example with the addition of manufacturer's joint 118. Each end 110, 112 and side 114, 116 preferably extends at the top edge into top flaps 120, 122 and 124, 126 respectively, and also extends at the bottom edge into bottom flaps (not shown), the bottom flaps overlapped and fastened with adhesive, staples or other fastening means, to form bottom 128.

At least one of the ends 110, 112 preferably both, have near their upper portion, cut portions defining handholes 130, 132 respectively, enabling hand grasping and carrying of the box. Preferably, the fiberboard is not completely cut away to form the handholes: tabs 134, 136 are formed by three cut edges and an upper edge scored only, to permit easy bending.

Inserted within the box is an I beam partition comprising preferably longitudinal center panel 150 extending at its latitudinal edges into foldably connected substantially L-shaped end panels 160, 162. The ell extensions of L-shaped end panels 160, 162 must be adjacent a same longitudinal edge of center panel 150. The L-shaped end panels are preferably substantially perpendicular to center panel 150 with the ell extensions pointing in the same direction (as shown) or in opposite directions.

For sake of clarity, dimensions parallel to the top edge of side 116 shall be lengths, parallel to the top edge of end 110, widths and parallel to edge 165, heights.

Center panel 150 is preferably of substantially the same length and parallel to sides 114, 116 in order for center panel 150 to fit snugly between ends 110, 112, dividing the box in two compartments. Center panel 150 may be longer than sides 114, 116 and thus diagonally dividing the box.

L-shaped end panels 160, 162 preferably have a widest area substantially equal to the width of ends 110, 112 in order for the former to lie snugly between sides 114, 116 and adjacent ends 110, 112 respectively. The I beam partition is thus snugly locked within the box.

At least one, preferably both, L-shaped end panels 160, 162 have in their widest area a cut portion defining apertures 164, 166. Apertures 164, 166 are preferably vertically and horizontally centered in the widest area of L-shaped end panels 160, 162 respectively. Apertures 164, 166 and handholes 130, 132 respectively must cooperate, and thus preferably align to enable easy and comfortable hand grasping of the box and I beam partition within.

The end panels and ends being adjacent provide a double fiberboard thickness, thus strengthening the ends of the box and in particular, the load carrying areas above the hand grasping handholes 130, 132. The strengthened load carrying areas will prevent against tears, and if desired, the addition of reinforcing bands, as described in FIG. 1, will even further strengthen such areas.

Tabs 134, 136 releasably lock the I beam partition in place, whether the end panels 160, 162 are of the same width or less than the ends 110, 112, and thereby, with the cooperation of the center panel 150, restricting outward bulging of ends 110, 112. Tabs 134, 136 also provide a comfortable upper hand grasping surface. The I beam partition does not expand in length particularly at its center panel area, and thus when snugly inserted within a box, prevents outwardly bulging of the ends.

It is preferable that the height of center panel 150, at its latitudinal end edges be about half the height of the L-shaped end panels. This ratio provides a strong connection between the center panel 150 and the end panels 160, 162 to prevent tearing. It also provides for the areas above and below apertures 164, 166 to be of a reasonable height not to be easily torn while the box is being carried.

Top flaps 120, 122 preferably have slit cuts 168, 170 respectively near and substantially perpendicular to their uppermost free edge. The slit cuts 168, 170 permit the top flaps 120, 122 to be folded inwardly adjacent L-shaped end panels 160, 162 with the upper portion of center panel 150 sliding in slits 168, 170. This feature is used when all the top flaps are inwardly bent, the two cell box being repacked with empty containers or bottles.

EXAMPLE

The following will serve to illustrate an embodiment of the invention. During a vertical pull test period under same conditions, beer boxes were filled with twenty-four beer bottles in a first case including twenty-four cell chipboard partition and reinforcing tape surrounding the box, and in a second case including I beam partition with reinforcing tape across as disclosed herein. The first box experienced ripping and deterioration after 1.5 swings, the second box after upwards of 2 swings, thereby extending the life of the box 33%.

The amount of reinforcing tape from the first box to the second box is reduced by at least 55%. The box dimensions are slightly reduced, as the separations between bottles, by a twenty-four cell chipboard partition, are all but eliminated when replaced by the disclosed I beam partition.

Furthermore, the second box has no graphic design problem as the outer bulge from a surrounding reinforcing tape is eliminated.

The I beam partition may be reused. The scrap value of the box alone or with I beam partition is increased as recycling difficulties caused by reinforcing tape inserts are eliminated or at least reduced, as the amount of reinforcing tape inserts is definitely reduced.

Modifications can be made without departing from the spirit of the invention, as defined in the appended claims.

I claim:

1. A fiberboard blank having a center panel with opposite side and end edges, said center panel extending at each of said end edges to define foldably connected substantially L-shaped end panels, each of said L-shaped end panels having an upward leg of a first width, a first portion of an edge of said upward leg foldably connected to said center panel, and said upward leg extending at a second portion of said edge into an ell extension of a second width, each said ell extension being adjacent one of said side edges of said center panel, said L-shaped end panels having a widest portion equivalent to said first and said second width, at least one of said L-shaped end panels having about the center of said widest portion a cut portion defining an aperture, adjacent said aperture in a first of said L-shaped end panels, a reinforcing band extends substantially across said widest portion of both said L-shaped end panels, said reinforcing band being cut between said L-shaped end panels, whereby each of said L-shaped end panels foldably connected to each end edge of said center panel, on being bent about said end edges extends substantially perpendicularly away from said center panel thereby defining an I beam partition to be snugly inserted in boxes having sides and ends to provide a removable strengthening partition having said reinforcing band said boxes being free of reinforcing bands, at least one of said ends having a handhole aligning with said aperture of said first of said L-shaped end panels, said reinforcing band on said I beam partition reinforcing said aperture and said handhole to prevent tears about said aperture and said handhole, said I beam partition also preventing inward and outward movements of said ends of said boxes.

2. The blank as defined in claim 1 wherein each of said L-shaped end panels are of a height in the order of about two times that of the height of said end edges to provide a strong foldable connection between said center panel and each of said L-shaped end panels and to enable said handhole aligning with said aperture to be in an upper half portion of said at least one end for equilibrium purpose when said boxes including said I beam partition are carried.

3. The blank as defined in claim 1 wherein said center panel extends between each said ell extension of said L-shaped end panels into an extension panel where said reinforcing band extend across said extension panel in line with said reinforcing bands, said reinforcing band being cut between each said L-shaped end panels and said extension panel.

4. In a top loading fiberboard box having opposite sides and ends in foldably connected arrangement, each of said sides and ends extending, respectively, into a foldably connected bottom and top flap, with means of fastening said bottom flaps to define a bottom, and at least one of said ends having near an upper central portion a handhole, said box being free of reinforcing bands, a removable snugly inserted I beam partition comprising a center panel with opposite side and end edges, said center panel extending perpendicularly at each of said end edges to define foldably connected substantially L-shaped end panels, each of said L-shaped end panels having an upward leg of a first width, a first portion of an edge of said upward leg foldably connected to said center panel, said upward leg extending at a second portion of said edge into an ell extension of a second width, said L-shaped end panels having a widest portion equivalent to said first and said second width, at least one of said L-shaped end panels having about the center of said widest portion a cut portion defining an aperture, adjacent said aperture, a reinforcing band extending substantially across said widest portion of each said L-shaped end panels, said reinforcing band being cut between said L-shaped end panels, whereby each of said L-shaped end panels is snugly positioned adjacent one of said ends to reinforce said ends, said center panel extending between said L-shaped end panels dividing said box in two portions and cooperating with said L-shaped end panels and said ends thereby preventing inward and outward movements of the ends of said box, said aperture cooperating with said handhole to enable hand grasping of said box and I beam partition, said reinforcing band reinforcing said aperture and said handhole to prevent tears about said aperture and said handhole.

5. The box as defined in claim 4 wherein the two top flaps extending from said opposite ends each have a slit cut substantially perpendicular to an outer free edge remote from said opposite ends, said slit cut cooperating with said center panel thereby enabling said two flaps to be bent inwardly center panel releasably locks said two flaps adjacent said end panels.

* * * * *